US006655524B2

(12) United States Patent
De Laforcade

(10) Patent No.: US 6,655,524 B2
(45) Date of Patent: Dec. 2, 2003

(54) ASSEMBLY FOR MIXING AT LEAST TWO PRODUCTS

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 75 days.

(21) Appl. No.: 09/885,118

(22) Filed: Jun. 21, 2001

(65) Prior Publication Data

US 2002/0020637 A1 Feb. 21, 2002

(30) Foreign Application Priority Data

Jun. 21, 2000 (FR) ..... 00 07925

(51) Int. Cl.[7] ..... B65D 25/08
(52) U.S. Cl. ..... 206/222; 206/568
(58) Field of Search ..... 206/219, 220, 206/221, 565, 222; 222/94, 129; 215/DIG. 8

(56) References Cited

U.S. PATENT DOCUMENTS 3,832,950 A * 9/1974 Hurst ..... 102/315
4,073,406 A 2/1978 Goncalves
4,386,696 A 6/1983 Goncalves
4,757,916 A * 7/1988 Goncalves ..... 222/83
4,986,322 A * 1/1991 Chibret et al. ..... 141/319
5,027,872 A * 7/1991 Taylor et al. ..... 141/347
5,209,565 A 5/1993 Goncalves
5,277,303 A 1/1994 Goyet et al.
5,409,141 A * 4/1995 Kikuchi et al. ..... 222/81
5,992,693 A 11/1999 Albisetti
6,244,433 B1 * 6/2001 Vieu ..... 206/221

FOREIGN PATENT DOCUMENTS

| | | |
|---|---|---|
| FR | 2 331 491 | 6/1977 |
| FR | 2 342 914 | 9/1977 |
| FR | 2 707 601 | 1/1995 |
| FR | 2 765 859 | 1/1999 |

OTHER PUBLICATIONS

Abstract of Fr 2 707 601.

* cited by examiner

*Primary Examiner*—Shian Luong
(74) *Attorney, Agent, or Firm*—Finnegan, Henderson, Farabow, Garrett & Dunner LLP

(57) ABSTRACT

An assembly for separately packaging two products for extemporaneous mixing comprises a first container and a second container. The first container contains a first product and delimits a first opening. A removable stopper is associated with the first opening. The second container contains a second product and delimits a second opening. The second container comprises a first coupling member. The first container and the second container are configured to be connected to one another. The first coupling member and the removable stopper are configured such that the first coupling member engages the removable stopper during establishment of a connection between the first container and the second container and the removable stopper passes into the second container so as to expose the first opening and allow the first product and the second product to be brought into contact with one another.

101 Claims, 3 Drawing Sheets

ASSEMBLY FOR MIXING AT LEAST TWO PRODUCTS

The present invention relates to a packaging apparatus and, in particular, an assembly for separately packaging and extemporaneously mixing at least two products. The two products may be mixed to form a composition, for example, a cosmetic composition, as used, for example, in the area of hair dyeing.

Home hair dyeing systems typically use two types of dye formula: creams packaged in an aluminum tube and gels packaged in a rigid bottle. Home hair dyeing systems may also utilize an oxidizing agent contained in a somewhat rigid bottle, often referred to as a "squeezy bottle." Alternatively, the oxidizing agent may be included in a system intended for automatically mixing the composition.

A great demand presently exists for the relatively rigid squeezy bottle to be replaced by a tube with more flexible walls into which the dye may be introduced at the time that the dye composition is to be used. Solutions have been proposed which are aimed at allowing a first tube, for example, a tube made of aluminum, containing a dye in the form of a cream, to be coupled to a second tube, for example, a tube made of thermoplastic, containing the oxidizing agent. Inverting one tube onto the other does not pose any problem when the tube to be inverted contains a product in the form of a cream. Once the two tubes have been coupled, all that is necessary is for pressure to be exerted on the walls of the tube containing the dye so as to drive its contents into the "receiving" tube containing the oxidizing agent. An air vent may be provided to compensate for the increase in volume of the product inside the receiving tube.

These proposed solutions pose may problems. First, between the instant that the tube containing the dye is opened and the instant that it is coupled in a sealed manner to the receiving tube, a certain space of time elapses during which the somewhat unpleasant smell of the dye (generally ammonia-based) spreads into the atmosphere. Furthermore, during this space of time, the dye is in contact with the air. This contact with the air gives rise, through oxidation, to degradation of the dye. Such degradation differs in intensity depending on the time required to manipulate the dye into the tube containing the oxidizing agent. Furthermore, when the dye and the oxidizing agent are in liquid form, it is difficult, if not impossible, to invert one of the tubes onto the other without spilling liquid through the joint between the two containers.

In the field of medicinal products, a relatively complicated system has been proposed for mixing a pharmaceutically active ingredient, particularly in solid form, with a solvent or diluent contained in a separate container. In this system, a first container containing the active ingredient is closed by a ball which is expelled into the first container when the second container containing the solvent is engaged with the first container via a coupling member provided on the second container so as to allow the two products to be mixed. Such a system is described in European Patent Publication No. 0 529 595.

One of the objectives of the system proposed in the '595 publication aims to avoid the stoppering device, in this instance the ball, dropping into the container from which the mixture will be taken. As a result, in order to homogenize the mixture, the device is turned head down so that the solvent is transferred into the first container, where it can be mixed homogeneously with the active ingredient. Once the mixture has been homogenized, the device is turned the other way up so as to allow the mixture produced to be transferred into the second container from which it can be dispensed.

This proposed device is complex in its production and in its use. The coupling member mounted on the second container prevents access to the mixture in the second container via the opening through which the two products were brought into contact with one another. Therefore, an auxiliary opening at the other end of the second container has to be provided. The mechanism that expels the ball is not particularly reliable. In addition, the mechanism that expels the ball takes up a substantial amount of space in the respective openings of each of the containers, which makes transferring liquid from one of the containers to the other difficult, particularly in the case of liquids of relatively high viscosity.

Another configuration is described in U.S. Pat. No. 4,386,696. In this disclosed configuration, the coupling means and the removable stopper are configured in such a way that when the first container is engaged with the second container, the removable stopper is not ejected. Thus, the profiles of the plug and/or the container in which mixing takes place are chosen accordingly. It is only in response to a movement in the opposite direction, that is, a movement aimed at disengaging the first and second containers from one another, that the removable stopper is ejected. Depending on the exact design, the movements involved are sometimes complicated, and successful opening could be somewhat unpredictable.

According to one optional aspect of the invention, an assembly for mixing at least two products comprises a first container and a second container. The first container contains a first product and delimits a first opening. A removable stopper is associated with the first opening. The second container contains a second product and delimits a second opening. The first coupling member and the removable stopper are configured such that the first coupling member engages the removable stopper during establishment of a connection between the first container and the second container and the removable stopper passes into the second container so as to expose the first opening and allow the first product and the second product to be brought into contact with one another. For example, the first coupling member could engage the stopper when the first container engages the second container and during establishment of a connection between the first container and the second container (e.g., the stopper engagement could take place shortly after initial engagement of the containers). The products could, for example, be brought into contact by passing the first product and/or the second product through the first and second openings.

According to another optional aspect of the invention, a product packaging system comprises a first container containing a first product and delimiting a first opening and a second container containing a second product and delimiting a second opening. A removable stopper may be associated with the first opening. The second container may comprise one or more camming members projecting from a surface of the second container. One or each camming member may be configured to engage the stopper and to expose the first opening and allow the first product and the second product to be brought into contact with one another. For example, this stopper removal could take place as the first container is connected to the second container.

According to still another optional aspect of the invention, a method of forming a mixture of at least two products comprises providing a system comprising a first product packaged in a first container, a removable stopper provided in a first opening of the first container, and a second product in a second container, wherein the second container comprises a second opening. The first container is connected to the second container. The method further comprises removing the stopper from the opening while the first container is being connected to the second container, passing the stopper into the second container, and mixing the first product and the second product.

According to yet another optional aspect of the invention, a method of preparing and applying a cosmetic composition is provided. The method comprises providing an assembly or system, mixing the first product and the second product together to prepare a cosmetic composition, dispensing cosmetic composition from the assembly, and applying the cosmetic composition to at least one of skin and hair.

According to still another optional aspect of the invention, an assembly for mixing at least two products comprises a first container and a second container. The first container contains a first product and delimits a first opening. A removable stopper is associated with the first opening. The second container contains a second product and delimits a second opening. During establishment of a connection between the first container and the second container, the first coupling member is configured to engage the removable stopper and move the removable stopper in a direction toward the second container so as to expose the first opening and allow the first product and the second product to be brought into contact with one another.

According to one optional embodiment of the invention, an assembly for the separate packaging and extemporaneous mixing of two products is provided. The two products may be mixed to form a composition, for example, a cosmetic composition. The assembly may comprise a first container containing a first product and delimiting a first opening and a second container containing a second product and delimiting a second opening. A removable stopper may be associated with the first opening. The second container may comprise a first coupling member being configured, when the first container is engaged with the second, to engage the removable stopper so as to uncover the first opening and to cause the removable stopper to pass into the second container so as to allow the first and second products to be brought into contact with one another via the first and second openings.

In an optional embodiment, rather than having a movement aimed at disengaging the first and second containers from one another cause mixing of the first and second products to occur, the engagement of the first and second containers may cause the removable stopper and the first coupling member to interact and enable mixing. In other words, when the first container is mounted on the second container according to this optional arrangement, mixing may take place; this could be in contrast to some conventional arrangements where mixing takes place during disassembly.

Optionally, the first and second products may be mixed in the second container. Mixing in the second container may make manipulation easier because, if the mixing were to take place in the first container, a removable stopper in the second container may impede the flow of the second product into the first container. Furthermore, when the first container contains a highly oxidizable product, for example, a dye, it may be beneficial to minimize the volume of air above the free surface of the product. As a result, the first container may not have a great enough volume for the first and second products to be mixed therein. In addition, the removable stopper may act as a stirrer to homogenize the mixture.

Optionally, the first and second products may be liquids. The first product may have a viscosity low enough that the first product can flow under gravity. In the case of a first product having a relatively high viscosity, the first container may comprise deformable walls so as to encourage the first product to be expelled into the second container. Alternatively, one of the products may be a powder.

A device according to the invention may be simple to use and economical to produce. Assuming that one of the products is readily oxidizable in contact with air and/or gives off an unpleasant smell, it may be stored in the first container. Indeed, once the removable stopper is in the second container and when the composition is mixed, the product contained in the first container may flow into the second without contacting the external air. When the stopper is released into the second container, the stopper could contribute to homogenizing the mixture before it is dispensed, without additional transferring operations needing to be performed. Furthermore, the stopper released into the second container optionally does not interfere with the flow of product from the first container to the second container. When the first container is engaged with the second container, there might be no unwanted flow of product transferred from the first container to the second container, regardless of the viscosity of the product.

The first and second containers may be initially disassociated from one another so that the assembly can be stored in external packaging, for example, cardboard packaging, of small size, for example, in terms of height, which also gives greater stability.

In one optional embodiment, the first container comprises a second coupling member capable of allowing the first container to engage with the second container. The second coupling member may make it easier for the product to be transferred from the first container to the second without unwanted flow at the joint between the first and second containers. Optionally, the coupling is reversible. In such a situation, the composition mixed, for example, in the second container may be dispensed through the same opening through which the product contained in the first container was conveyed into the second container. The second coupling member may comprise a screw thread intended to collaborate with a corresponding screw thread provided on a neck of the first container. Thus, the second coupling member may be mounted on the first container. Alternatively, the second coupling member may be mounted to the first container by other known devices, for example, by snap-fastening.

According to another optional embodiment, the second coupling member may comprise a first screw thread configured to cooperate with a corresponding screw thread provided on the second container so as to allow the first coupling member to engage with the removable stopper. In addition, the second coupling member may comprise an edge delimiting the first opening in which the removable stopper may be mounted. The removable stopper may be force-fitted into the first opening or, alternatively, it may be screwed in.

Optionally, the first coupling member may be rotationally fixed relative to the second container. Such rotational immobilization may be afforded, for example, by the collaboration of appropriate teeth and grooves.

According to another optional embodiment, the first coupling member may be configured in such a way as, in response to the relative rotation of one of the containers with respect to the other, to cause axial and angular movement of the removable stopper such that the stopper disengages from the first coupling member and is released into the second container. For this purpose, the first coupling member may be configured in the form of a sleeve. The sleeve may comprise an edge delimiting the second opening and an interior surface having one or more camming members configured to cooperate with one or more corresponding camming members provided on an exterior surface of the removable stopper. The camming members may be configured, for example, as screw threads or ramps.

Optionally, before being engaged with one another with a view toward mixing, the first and second containers may each be associated with a removable cap. The cap associated with the first container may have a screw thread configured to cooperate with the first screw thread of the second coupling member. The cap associated with the second container may comprise a screw thread configured to cooperate with the screw thread provided on the neck of the second container.

The cap associated with the first container may include a portion configured to engage the removable stopper so as to prevent the removable stopper from being accidentally removed, for example, when the assembly is being transported or stored. Such engaging may simply comprise the cap bearing on a corresponding surface of the removable stopper.

According to yet another optional embodiment, the cap associated with the second container may be configured in the form of an applicator tip. Also, the first container may be reversibly engaged with the second container so that once the first and second products have been mixed, the first and second containers can be disengaged from one another. Then, the cap formed as an applicator tip may be positioned back on the second container so as to allow localized application of the composition to a surface that is to be treated. The applicator tip may comprise a break-off end, the twisting of which, for example, by a movement about the axis of the tip, may make it possible to uncover an applicator orifice.

The second container may be configured, for example, in the form of a tube. The second container may comprise a shoulder separating the body of the container from a neck of the container where the first coupling member may be mounted. The shoulder may be configured such that when the second container rests flat on a surface, the level of product in the second container is below the lowermost point of the second opening. Thus, having removed the cap associated with the second container and while removing the cap associated with the first container, the user may lay the second container flat on a flat surface, with no risk that the product will spill out unintentionally.

The first container may comprise a bottle, for example, a bottle made of polyvinyl chloride or of glass. Alternatively, the first container may comprise a tube, for example, a tube made of aluminum. The second container may comprise a bottle or a tube made, for example, of polyethylene, with at least one wall that can be deformed elastically in response to pressure exerted at a right angle to the at least one wall. Therefore, the composition may be forced to exit by pressing the at least one wall of the second container. Alternatively, in the case of a second container with walls which are not appreciably deformable, the mixture may be dispensed under gravity, for example, in the case of a highly fluid mixture, or, in the case of a mixture which is not as fluid, by using a manually operated pump, for example, a pump having an applicator tip provided thereon.

The assembly may be used, for example, to prepare a cosmetic composition, for example, a hair composition. In one optional embodiment, the first product may comprise a dye, and the second product may comprise an oxidizing agent.

Aside from the structural and procedural arrangement set forth above, there could be a number of other arrangements, such as those explained hereinafter. It is to be understood that both the foregoing description and the following description are exemplary.

The accompanying drawings are included to provide a further understanding of certain aspects and are incorporated in and constitute a part of this specification. The drawings illustrate an optional embodiment and, together with the description, serve to explain certain principles.

In the drawings.

Reference will now be made in detail to an optional embodiment of the invention, an example of which is illustrated in the drawings. Wherever possible, the same reference numerals are used in the drawings and specification to refer to the same parts.

Figure 1:
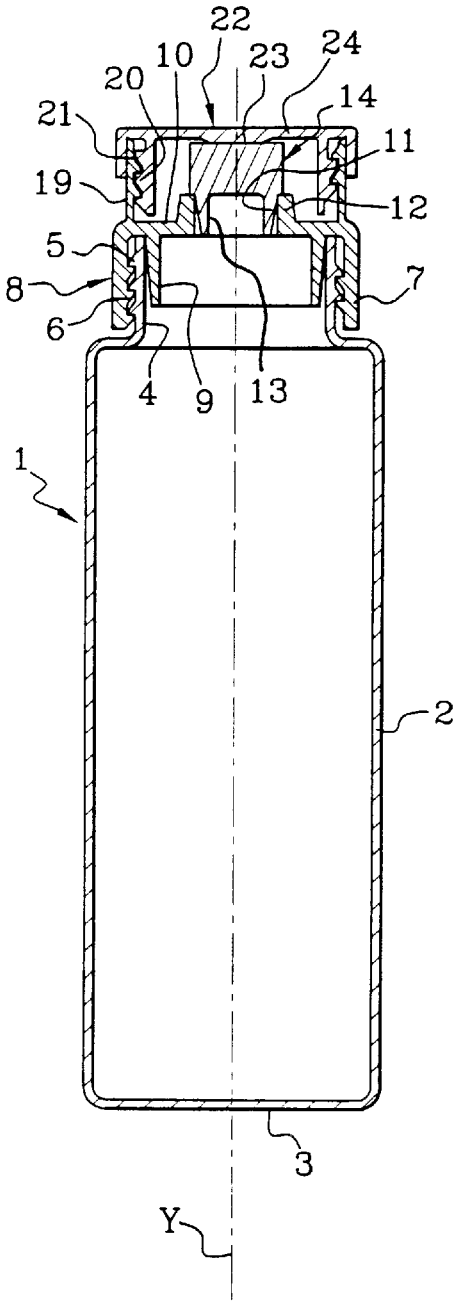
FIG. 1 is a cross-sectional view of a first container of an exemplary assembly according to the invention.

In accordance with the present invention, a packaging apparatus is provided. The assembly 100 depicted in FIGS. 1 to 3 may comprise a first container 1 (FIG. 1) containing a first product, for example, an oxidization dye, and a second container 50 (FIG. 2) containing a second product, for example, an oxidizing agent. The two products, once mixed, may form a composition, for example, a hair dye composition.

The second container 50 may comprise a bottle or a tube, for example, a polyethylene tube, having at least one wall. The at least one wall of the second container 50 may be deformable when subjected to pressure directed at a right angle to the surface of the at least one wall. The second container 50 may comprise a body 51 having an axis X. One end 52 of the body may be closed. The other opposite end may comprise a neck 53 separated from the body 51 by a shoulder 54. The exterior surface of the neck 53 may have a screw thread 55 configured to cooperate with a corresponding screw thread 56 formed on the internal surface of a skirt 57 forming part of an applicator tip 58. The applicator tip 58 may comprise a break-off end 59 which, in response to twisting about the axis X, may break off to uncover an applicator orifice 60 through which the composition may be dispensed and applied locally to the hair.

Arranged in the neck 53 is a first coupling member 61 formed of a cylindrical sleeve fitted tightly inside the neck 53. The coupling member 61 is immobilized in terms of rotation inside the neck 53 by means of teeth 62 formed by a rim of the neck 53 and capable of engaging with corresponding notches 63 formed in the exterior surface of the coupling member 61. The applicator tip 61 also comprises a covering skirt 64 and an internal skirt 65, a free edge of which is intended, when the applicator tip 58 is in the position in which it is screwed onto the container 50, to rest on a rim 66 formed by the coupling member 61 so as to improve the sealing of the container 50. The rim 66 of the coupling member 61 delimits an opening 67 for the second container 50.

An interior surface of the coupling member 61 may comprise camming members 68, for example, two portions of screw thread or two ramped surfaces, arranged diametrically opposite each other. The camming members 68 may be configured to engage with corresponding camming members provided on a removable stopper with which the first container 1 may be equipped. The camming members 68 may be configured in any known manner capable of engaging the corresponding camming members and dislodging the removable stopper.

Figure 2:
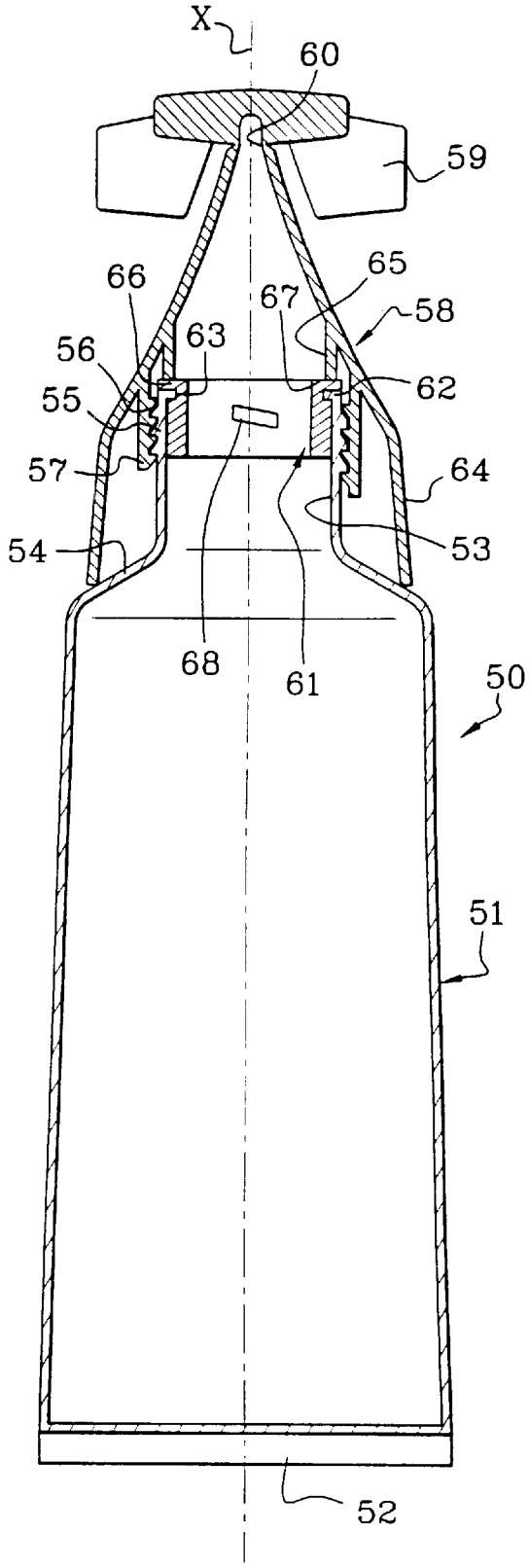
FIG. 2 is a cross-sectional view of a second container of an exemplary assembly according to the invention.

The first container 1, as depicted in FIG. 1, may comprise a tube or a bottle, for example, a polyvinyl chloride (PVC) bottle. The first container 1 may comprise a body 2 having an axis Y. The first container 1 may include a closed, flat end 3 and an opposite end comprising a neck 4. An exterior surface of the neck 4 may have a screw thread 5 configured to cooperate with a corresponding screw thread 6 provided on the interior surface of a skirt 7 forming part of a second coupling member 8. A sealing skirt 9, concentric with the skirt 7, may be formed by the second coupling member 8 and may be configured to be inserted in a sealed manner into the neck 4 of the bottle 1. One end of each of the skirts 7 and 9 connects to a transverse wall 10. The center of the transverse wall 10 may have an opening 11 delimited by a rim 12 directed away from the skirts 7 and 9. A skirt 13 of a removable stopper 14 may be force-fitted into the opening 11, sealing the opening 11 closed.

Figure 3:
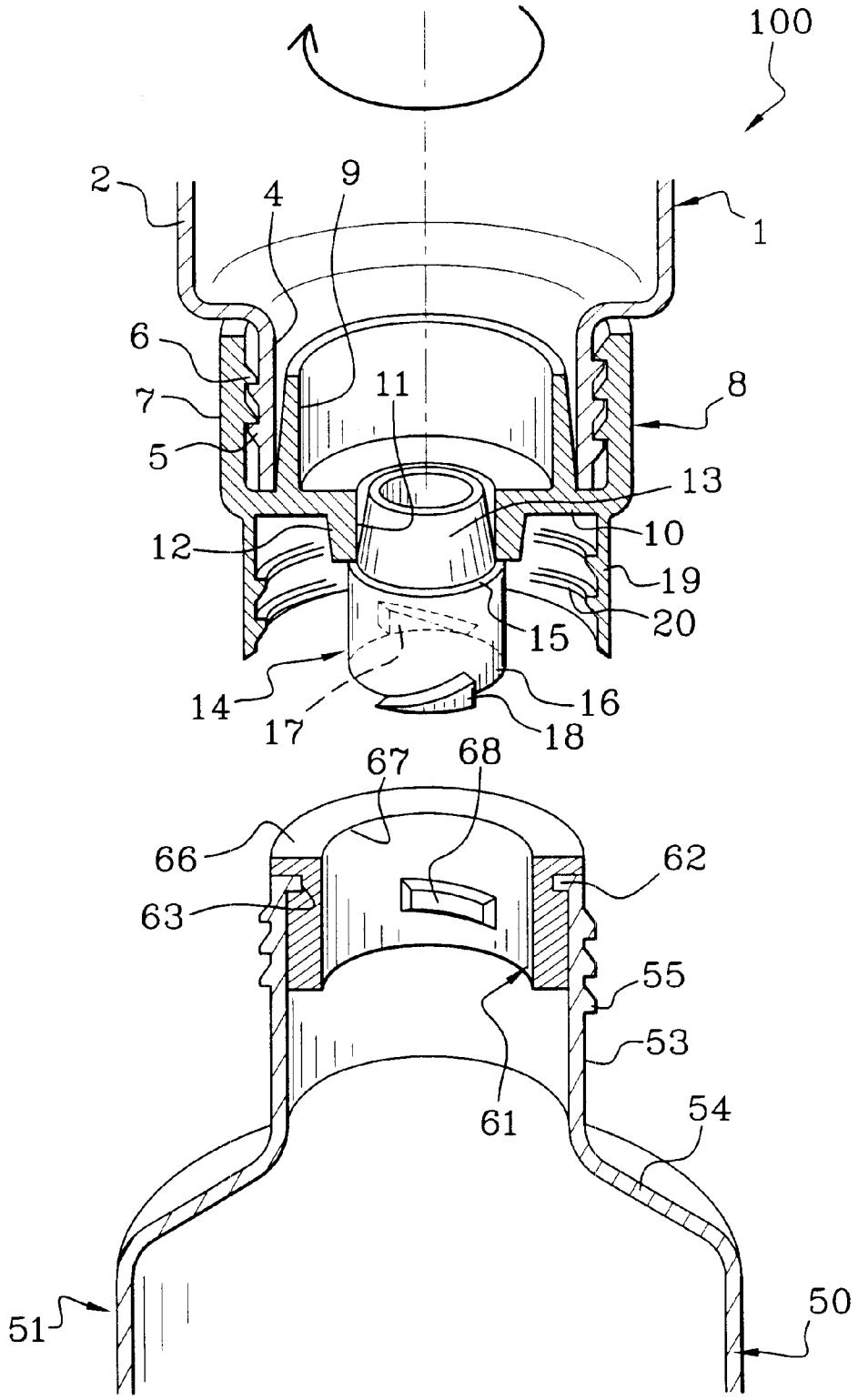
FIG. 3 is a detailed cross-sectional view of portions of the first and second containers shown in FIGS. 1 and 2.

Referring to FIG. 3, the skirt 13 of the removable stopper 14 may be connected via a shoulder 15 to a cylindrical portion 16 of larger diameter than that of the skirt 13. When the removable stopper 14 is in the mounted position, the shoulder 15 may be in abutment against the free end of the rim 12 formed by the coupling member 8. The cylindrical portion 16 of the removable stopper 14 may comprise, on its exterior surface, two camming members 17, 18, for example, two portions of screw thread or two ramped surfaces. The camming members 17, 18 may be diametrically opposed and configured to cooperate with the camming members 68 of the coupling member 61 with which the second container 50 may be equipped. The camming members 17, 18 may be configured in any known manner capable of engaging the corresponding camming members on the second container.

Extending in a direction opposite that of the skirts 7 and 9, the coupling member 8 may comprise a skirt 19. The internal surface of the skirt 19 may comprise a screw thread 20 configured to cooperate with a screw thread 21 of a removable cap 22. When the removable cap 22 is in the mounted position, as illustrated in FIG. 1, a portion 23 of the cap 22 rests on a corresponding portion of a transverse surface 24 of the removable stopper 14, so as to prevent any accidental removal thereof, for example, when the assembly is being transported or stored.

Referring again to FIG. 3, the screw thread 20 of the coupling member 8 may be configured, once the cap 22 and the applicator tip 58 have been removed, to cooperate with the screw thread 55 provided on the neck 53 of the tube 50.

Figure 4C:
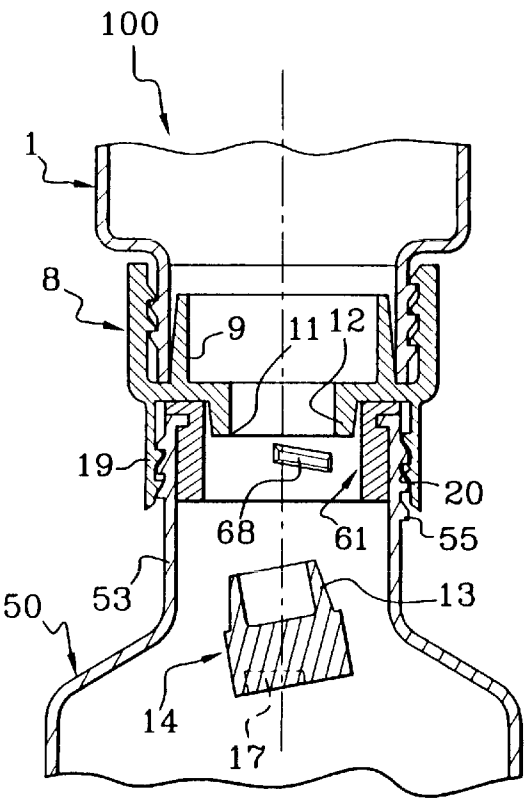
FIGS. 4A–4C illustrate steps in an exemplary operation of the assembly depicted in FIGS. 1–3.

With a view toward mixing and dispensing the composition, a user may remove the applicator tip 58 from the container 50, place the container 50 flat on a table, the level of product contained in the container 50 being, when the container 50 is in this position, below the lowermost point of the opening 67. Similarly, the user may remove the cap 22 from the container 1 and invert the container 1 onto the container 50 so as to bring the screw thread 20 of the coupling member 8 of the container 1 to face the screw thread 55 of the neck 53 of the container 50. As viewed in FIG. 4A, the second container 50 may be positioned below the first container 1.

Figure 4B:
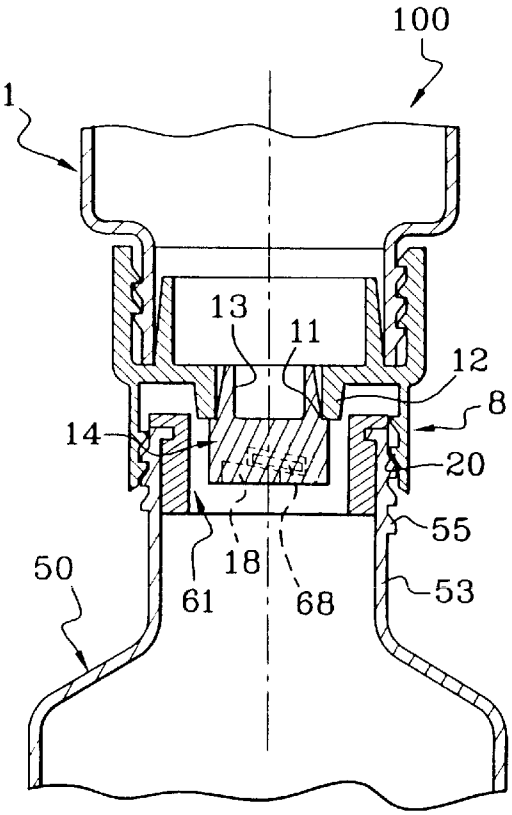
Figure 4A:
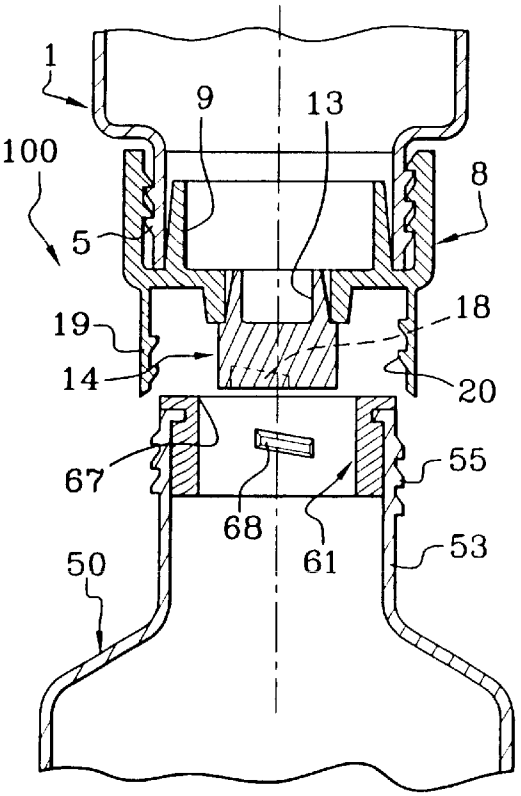

Referring to FIG. 4B, the screw thread 20 of the coupling member 8 of the container 1 may be engaged with the screw thread 55 of the neck 53 of the container 50. Shortly after the screw threads 20 and 55 engage, the camming members 17,18 of the removable stopper 14 may be engaged with the camming members 68 of the coupling member 61 by turning one of the containers relative to the other. Meanwhile, the coupling member 61 may be kept fixed in terms of rotation inside the neck 53 of the container 50. As a result, the removable stopper 14 may be driven with a movement that has both an angular and an axial component until such time as the skirt 13 of the removable stopper 14 disengages from the opening 11 delimited by the rim 12 of the coupling member 8.

For example, in order to generate the axial and angular movement of the stopper 14, the slope or pitch of one or more of the camming members 17, 18, 68 may be greater than that of the screw threads 20, 55 configured to engage the first container 1 with the second container 50. As a result of the greater slope, the camming members 17, 18, 68 may cause the removable stopper 14 to disengage from the opening 11.

Relative rotation of one of the containers with respect to the other may continue until the camming members 17, 18 of the removable stopper 14 are no longer engaged with the camming members 68 of the coupling member 61. At that moment, as shown in FIG. 4C, the removable stopper 14 may be released into the second container 50. The product contained in the first container 1 may then flow under gravity into the second container 50.

Once the first container has been completely emptied, the user may turn the first container 1 and the second container 50 in a relative rotation in the opposite direction to that shown in FIG. 4B so as to disengage the first container 1 from the second container 50. The user may put the applicator tip 58 back on the second container 50, which is once again in the configuration shown in FIG. 2. After closing the container, the user may shake the container so as to homogenize the mixture. Then the user may break off the break-off end 59 so as to uncover the applicator orifice 60. The dye composition may then be applied in a conventional manner.

It will be apparent to those skilled in the art that various modifications and variations can be made to the apparatus and method described herein. Other embodiments of the invention will be apparent to those skilled in the art. It is intended that the specification and examples be considered as exemplary only.

What is claimed is:

1. An assembly for mixing at least two products, comprising:

a first container containing a first product and delimiting a first opening;

a removable stopper associated with the first opening; and a second container containing a second product and delimiting a second opening, the second container comprising a first coupling member, wherein the first container and the second container are configured to be connected to one another, and wherein the first coupling member and the removable stopper are configured such that the first coupling member engages the removable stopper during establishment of a connection between the first container and the second container and the removable stopper passes into the second container so as to expose the first opening and allow the first product and the second product to be brought into contact with one another.

2. The assembly of claim 1, wherein exposing the first opening allows at least one of the first product and the second product to flow through the first opening and the second opening.

3. The assembly of claim 2, wherein the first product and the second product are brought into contact and mixed in the second container.

4. The assembly of claim 1, wherein the first container comprises a second coupling member configured to allow the first container to engage the second container.

5. The assembly of claim 4, wherein the second coupling member comprises a first screw thread configured to cooperate with a corresponding screw thread of the second container, in response to a relative rotational movement of the first container with respect to the second container, to allow the first coupling member to engage the removable stopper.

6. The assembly of claim 5, wherein the second coupling member comprises an edge delimiting the first opening.

7. The assembly of claim 6, wherein the removable stopper is force-fitted into the first opening.

8. The assembly of claim 5, wherein the first container comprises a neck, and wherein the second coupling member comprises a second screw thread configured to cooperate with a corresponding screw thread of the neck of the first container to mount the second coupling member to the first container.

9. The assembly of claim 1, wherein the first coupling member is rotatably fixed with respect to the second container.

10. The assembly of claim 1, wherein the first coupling member is configured, in response to rotation of the first container relative to the second container, to cause the removable stopper to move axially and rotationally such that the removable stopper disengages from the second coupling member and is released into the second container.

11. The assembly of claim 10, wherein the first coupling member comprises a sleeve having an edge delimiting the second opening and an interior surface having at least one camming member configured to cooperate with at least one corresponding camming member on an exterior surface of the removable stopper.

12. The assembly of claim 11, wherein the at least one camming member on the interior surface of the sleeve comprises at least a portion of a screw thread projecting from the sleeve and the at least one corresponding camming member comprises at least a portion of a screw thread.

13. The assembly of claim 1, further comprising a first removable cap associated with the first container and a second removable cap associated with the second container.

14. The assembly of claim 13, wherein the first container comprises a second coupling member configured to allow the first container to engage the second container, and wherein the second coupling member comprises a first screw thread and the first removable cap comprises a screw thread configured to cooperate with the first screw thread of the second coupling member.

15. The assembly of claim 13, wherein the second container comprises a neck and the second removable cap comprises a screw thread configured to cooperate with a corresponding screw thread of the neck of the second container.

16. The assembly of claim 13, wherein the first removable cap comprises at least one portion configured to engage the stopper and prevent unintentional removal of the stopper.

17. The assembly of claim 13, wherein the second removable cap comprises an applicator tip, the applicator tip being configured to be repositionable on the second container.

18. The assembly of claim 17, wherein the applicator tip allows localized application of the mixed products to a surface to be treated.

19. The assembly of claim 17, wherein the applicator tip comprises a break-off end.

20. The assembly of claim 1, wherein the second container comprises a tube.

21. The assembly of claim 20, wherein the tube comprises a body, a neck, and a shoulder, the shoulder separating the body from the neck.

22. The assembly of claim 21, wherein the first coupling member is configured to mount on the neck, the shoulder being configured such that when the second container is laying on a surface, a level of second product is below a lowermost point of the second opening.

23. The assembly of claim 1, wherein the first container comprises a bottle.

24. The assembly of claim 23, wherein the bottle comprises at least one of polyvinyl chloride and glass.

25. The assembly of claim 1, wherein the first container comprises a tube.

26. The assembly of claim 25, wherein the tube comprises aluminum.

27. The assembly of claim 1, wherein the second container comprises one of a bottle and a tube.

28. The assembly of claim 27, wherein the second container comprises polyethylene.

29. The assembly of claim 27, wherein the second container comprises at least one wall that can be deformed elastically in response to pressure exerted at a right angle to a surface of the at least one wall.

30. The assembly of claim 1, wherein the first and the second mixed to prepare a cosmetic composition.

31. The assembly of claim 30, wherein the cosmetic composition comprises a hair composition.

32. The assembly of claim 30, wherein the first product comprises a dye and the second product comprises an oxidizing agent.

33. A method of preparing and applying a cosmetic composition, comprising:

providing the assembly of claim 1;

mixing the first product and the second product together to prepare a cosmetic composition;

dispensing cosmetic composition from the assembly; and applying the cosmetic composition to at least one of skin and hair.

34. The method of claim 33, wherein the cosmetic composition comprises a hair composition and said applying the cosmetic composition comprises applying the hair composition to hair.

35. The method of claim 34, wherein the first product comprises a dye and the second product comprises an oxidizing agent.

36. A product packaging system, comprising:

a first container containing a first product and delimiting a first opening;

a removable stopper associated with the first opening; and a second container containing a second product and delimiting a second opening, the second container comprising at least one camming member projecting from a surface of the second container, the at least one camming member being configured to engage the stopper so as to expose the first opening and allow the first product and the second product to be brought into contact with one another, wherein a substantial portion of the removable stopper is removed from the first opening and allowed to pass into the second container.

37. The system of claim 36, wherein the first container and the second container are configured to be connected to one another, and wherein the at least one camming member is engageable with the removable stopper during establishment of a connection between the first container and the second container.

38. The system of claim 36, wherein the entire removable stopper is removed from the first opening and allowed to pass into the second container.

39. The system of claim 36, wherein exposing the first opening allows at least one of the first product and the second product to flow through the first opening and the second opening.

40. The system of claim 39, wherein the first product and the second product are brought into contact and mixed in the second container.

41. The system of claim 36, wherein the second container comprises a first coupling member, the first coupling member comprising the at least one camming member, and wherein the first container comprises a second coupling member configured to allow the first container to engage the second container.

42. The system of claim 41, wherein the second coupling member comprises a first screw thread configured to cooperate with a corresponding screw thread of the second container, in response to a relative rotational movement of the first container with respect to the second container, to allow the first coupling member to engage the removable stopper.

43. The system of claim 42, wherein the second coupling member comprises an edge delimiting the first opening.

44. The system of claim 43, wherein the removable stopper is force-fitted into the first opening.

45. The system of claim 42, wherein the first container comprises a neck, and wherein the second coupling member comprises a second screw thread configured to cooperate with a corresponding screw thread of the neck of the first container to mount the second coupling member to the first container.

46. The system of claim 41, wherein the first coupling member is rotatably fixed with respect to the second container.

47. The system of claim 41, wherein the first coupling member is configured, in response to rotation of the first container relative to the second container, to cause the removable stopper to move axially and rotationally such that the removable stopper disengages from the second coupling member and is released into the second container.

48. The system of claim 47, wherein the first coupling member comprises a sleeve having an edge delimiting the second opening and an interior surface having the at least one camming member configured to cooperate with at least one corresponding camming member on an exterior surface of the removable stopper.

49. The assembly of claim 48, wherein the at least one camming member on the interior surface of the sleeve comprises at least a portion of a screw thread projecting from the sleeve and the at least one corresponding camming member comprises at least a portion of a screw thread.

50. The system of claim 36, further comprising a first removable cap associated with the first container and a second removable cap associated with the second container.

51. The system of claim 50, wherein at least one of the first container and the second container comprises a coupling member comprising a screw thread, wherein the first removable cap comprises a screw thread configured to cooperate with the screw thread of the coupling member.

52. The system of claim 50, wherein the second container comprises a neck and the second removable cap comprises a screw thread configured to cooperate with a corresponding screw thread of the neck of the second container.

53. The system of claim 50, wherein the first removable cap comprises at least one portion configured to engage the stopper and prevent unintentional removal of the stopper.

54. The system of claim 50, wherein the second removable cap comprises an applicator tip, the applicator tip being configured to be repositionable on the second container.

55. The system of claim 54, wherein the applicator tip allows localized application of a mixture of the products to a surface to be treated.

56. The system of claim 54, wherein the applicator tip comprises a break-off end.

57. The system of claim 36, wherein the second container comprises a tube.

58. The system of claim 57, wherein the tube comprises a body, a neck, and a shoulder, the shoulder separating the body from the neck.

59. The system of claim 58, wherein the first coupling member is mountable on the neck, the shoulder being configured such that when the second container is laying on a surface, a level of second product is below a lowermost point of the second opening.

60. The system of claim 36, wherein the first container comprises a bottle.

61. The system of claim 60, wherein the bottle comprises at least one of polyvinyl chloride and glass.

62. The system of claim 36, wherein the first container comprises a tube.

63. The system of claim 62, wherein the tube comprises aluminum.

64. The system of claim 36, wherein the second container comprises one of a bottle and a tube.

65. The system of claim 64, wherein the second container comprises polyethylene.

66. The system of claim 65, wherein the second container comprises at least one wall that can be deformed elastically in response to pressure exerted at a right angle to a surface of the at least one wall.

67. The system of claim 36, wherein the first product and the second product are mixed to prepare a cosmetic composition.

68. The system of claim 67, wherein the cosmetic composition comprises a hair composition.

69. The system of claim 67, wherein the first product comprises a dye and the second product comprises an oxidizing agent.

70. A method of preparing and applying a cosmetic composition, comprising:

providing the system of claim 36;

mixing the first product and the second product together to prepare a cosmetic composition;

dispensing cosmetic composition from the system;

passing the stopper into the second container; and applying the cosmetic composition to at least one of skin and hair.

71. The method of claim 70, wherein the cosmetic composition comprises a hair composition and said applying the cosmetic composition comprises applying the hair composition to hair.

72. The method of claim 71, wherein the first product comprises a dye and the second product comprises an oxidizing agent.

73. A method of forming a mixture of at least two products, comprising:

providing a system comprising:

a first product packaged in a first container, a removable stopper provided in a first opening of the first container, and a second product packaged in a second container, the second container comprising a second opening;

connecting the first container to the second container;

removing the stopper from the opening during establishment of a connection between the first container and the second container;

passing the stopper into the second container; and mixing the first product and the second product.

74. The method of claim 73, wherein said removing the stopper comprises engaging the stopper with a camming member of the second container.

75. The method of claim 73, wherein said removing comprises moving the stopper toward the second container.

76. The method of claim 73, wherein said mixing comprises mixing the first product and the second product in the second container.

77. The method of claim 76, wherein said mixing comprises mixing the first product and the second product together to prepare a cosmetic composition.

78. The method of claim 77, further comprising dispensing cosmetic composition from the second container.

79. The method of claim 78, further comprising applying the cosmetic composition to at least one of skin and hair.

80. The method of claim 79, wherein the cosmetic composition comprises a hair composition and said applying the cosmetic composition comprises applying the hair composition to hair.

81. The method of claim 80, wherein the first product comprises a dye and the second product comprises an oxidizing agent.

82. An assembly for mixing at least two products, comprising:

a first container containing a first product and delimiting a first opening;

a removable stopper with first opening; and a second container containing a second product and delimiting a second opening, the second container comprising a first coupling member, wherein the first container and the second container are configured to be connected to one another, and wherein, during establishment of a connection between the first container and the second container, the first coupling member is enageable with the removable stopper and move the removable stopper in a direction toward the second container so as to expose the first opening and allow the first product and the second product to be brought into contact with one another.

83. The assembly of claim 82, wherein exposing the first opening allows at least one of the first product and the second product to flow through the first opening and the second opening.

84. The assembly of claim 83, wherein the first product and the second product are brought into contact and mixed in the second container.

85. The assembly of claim 82, wherein the first container comprises a second coupling member configured to allow the first container to engage the second container.

86. The assembly of claim 85, wherein the second coupling member comprises a first screw thread configured to cooperate with a corresponding screw thread of the second container, in response to a relative rotational movement of the first container with respect to the second container, to allow the first coupling member to engage the removable stopper.

87. The assembly of claim 86, wherein the second coupling member comprises an edge delimiting the first opening.

88. The assembly of claim 87, wherein the removable stopper is force-fitted into the first opening.

89. The assembly of claim 86, wherein the first container comprises a neck, and wherein the second coupling member comprises a second screw thread configured to cooperate with a corresponding screw thread of the neck of the first container to mount the second coupling member to the first container.

90. The assembly of claim 82, wherein the first coupling member is rotatably fixed with respect to the second container.

91. The assembly of claim 82, wherein the first coupling member is configured, in response to rotation of the first container relative to the second container, to cause the removable stopper to move axially and rotationally such that the removable stopper disengages from the second coupling member and is released into the second container.

92. The assembly of claim 91, wherein the first coupling member comprises a sleeve having an edge delimiting the second opening and an interior surface having at least one camming member configured to cooperate with at least one corresponding camming member on an exterior surface of the removable stopper.

93. The assembly of claim 92, wherein the at least one camming member on the interior surface of the sleeve comprises at least a portion of a screw thread projecting from the sleeve and the at least one corresponding camming member comprises at least a portion of a screw thread.

94. The assembly of claim 82, further comprising a first removable cap associated with the first container and a second removable cap associated with the second container.

95. The assembly of claim 94, wherein the first container comprises a second coupling member configured to allow the first container to engage the second container, and wherein the second coupling member comprises a first screw thread and the first removable cap comprises a screw thread configured to cooperate with the first screw thread of the second coupling member.

96. The assembly of claim 94, wherein the second container comprises a neck and the second removable cap comprises a screw thread configured to cooperate with a corresponding screw thread of the neck of the second container.

97. The assembly of claim 94, wherein the first removable cap comprises at least one portion configured to engage the stopper and prevent unintentional removal of the stopper.

98. The assembly of claim 94, wherein the second removable cap comprises an applicator tip, the applicator tip being configured to be repositionable on the second container.

99. The assembly of claim 82, wherein the first product and the second product are mixed to prepare a cosmetic composition.

100. A method of preparing and applying a cosmetic composition, comprising:

providing the assembly of claim 82;

mixing the first product and the second product together to prepare a cosmetic composition;

dispensing cosmetic composition from the assembly; and applying the cosmetic composition to at least one of skin and hair.

101. The method of claim 100, wherein the cosmetic composition comprises a hair composition and said applying the cosmetic composition comprises applying the hair composition to hair.

* * * * *

UNITED STATES PATENT AND TRADEMARK OFFICE

CERTIFICATE OF CORRECTION

PATENT NO. : 6,655,524 B2
DATED : December 2, 2003
INVENTOR(S) : De Laforcade

It is certified that error appears in the above-identified patent and that said Letters Patent is hereby corrected as shown below:

Column 10,
Line 28, “first and” should read -- first product and --.
Line 29, “second mixed” should read -- second product are mixed --.

Column 13,
Line 29, “stopper with first” should read -- stopper associated with the first --.

Signed and Sealed this

Third Day of February, 2004

JON W. DUDAS
*Acting Director of the United States Patent and Trademark Office*